US006811352B1

(12) United States Patent
Meerkerk

(10) Patent No.: US 6,811,352 B1
(45) Date of Patent: Nov. 2, 2004

(54) REVETMENT FOR A BANK

(75) Inventor: Pleun Meerkerk, Nieuw-Lekkerland (NL)

(73) Assignee: Den Boer Beton Groot Ammers B.V., Nieuwpoort (NL)

( * ) Notice: Subject to any disclaimer, the term of this patent is extended or adjusted under 35 U.S.C. 154(b) by 549 days.

(21) Appl. No.: 09/180,901

(22) PCT Filed: May 14, 1997

(86) PCT No.: PCT/NL97/00270

§ 371 (c)(1),
(2), (4) Date: Dec. 22, 1998

(87) PCT Pub. No.: WO97/43487

PCT Pub. Date: Nov. 20, 1997

(30) Foreign Application Priority Data

May 15, 1996 (NL) ..... 1003138

(51) Int. Cl.[7] ..... E02B 3/12
(52) U.S. Cl. ..... 405/17; 52/604
(58) Field of Search ..... 405/15, 16, 17, 405/19, 20, 284, 286; 52/608, 604, 605, 606

(56) References Cited

U.S. PATENT DOCUMENTS

| | | | | | |
|---|---|---|---|---|---|
| 708,472 | A | * | 9/1902 | Flood | 52/608 |
| 837,163 | A | * | 11/1906 | Whisler | 52/608 |
| 2,172,714 | A | * | 9/1939 | Schack et al. | 52/604 |
| 2,577,170 | A | * | 12/1951 | Walters | 52/606 |
| 2,833,532 | A | * | 5/1958 | Ries | 52/606 |
| 3,096,621 | A | | 7/1963 | Danel | |
| 3,310,906 | A | * | 3/1967 | Glukes | 405/16 |
| 3,597,928 | A | * | 8/1971 | Pilaar | 61/38 |
| 4,474,504 | A | * | 10/1984 | Whitman et al. | 405/16 |
| 4,521,138 | A | * | 6/1985 | Steiner | 405/284 |
| 4,661,012 | A | * | 4/1987 | McCloskey | 405/16 |
| 4,781,492 | A | * | 11/1988 | Shindo | 405/16 |
| 4,896,999 | A | * | 1/1990 | Ruckstuhl | 405/286 |
| 5,044,834 | A | * | 9/1991 | Janopaul, Jr. | 405/284 |
| 5,186,574 | A | | 2/1993 | Tavares | |
| 5,257,880 | A | * | 11/1993 | Janopaul, Jr. | 405/284 |
| 5,337,527 | A | * | 8/1994 | Wagenaar | 52/169.2 |
| 5,548,938 | A | * | 8/1996 | Scheiwiller | 52/604 |
| 5,622,456 | A | * | 4/1997 | Risi et al. | 405/284 |
| 5,647,185 | A | * | 7/1997 | Forlini | 52/604 |
| 5,779,391 | A | * | 7/1998 | Knight | 405/20 |
| 5,890,836 | A | * | 4/1999 | Leech | 405/16 |
| 5,906,456 | A | * | 5/1999 | Knight | 405/20 |
| 5,951,210 | A | * | 9/1999 | Maguire et al. | 405/286 |

FOREIGN PATENT DOCUMENTS

| | | | | |
|---|---|---|---|---|
| CH | 65870 | * | 1/1914 | 50/262 |
| DE | 1930835 | | 1/1966 | |
| DE | 1634005 | | 1/1971 | |
| DE | 2457120 | * | 6/1975 | 52/608 |
| DE | 2415782 | * | 10/1975 | 52/608 |
| EP | 233603 | * | 8/1987 | E01C/5/00 |
| FR | 1515682 | | 3/1968 | |
| FR | 2184323 | | 12/1973 | |
| FR | 2657638 | * | 1/1990 | E04C/1/100 |
| NL | 122279 | | 12/1966 | |
| WO | 95/16076 | | 6/1995 | |

* cited by examiner

*Primary Examiner*—Robert E. Pezzuto
*Assistant Examiner*—Alexandra K. Pechhold
(74) *Attorney, Agent, or Firm*—Young & Thompson

(57) ABSTRACT

A revetment for bank, water-retaining structure and the like includes elements made of concrete or a similar material, which elements are approximately prismatic in the height direction and each have two transverse faces and two longitudinal faces which run parallel to their height direction. One transverse face of each element is made a concave shape, and the other transverse face is made a corresponding convex shape, in such a way that the elements can rest with their transverse faces against each other in various rotated positions.

6 Claims, 2 Drawing Sheets

REVETMENT FOR A BANK

BACKGROUND OF THE INVENTION

The invention relates to a revetment for a bank, water-retaining retaining structure and the like, comprising elements made of concrete or a similar material resting against each other, which elements are approximately prismatic in the height direction and each have two transverse faces and two longitudinal faces between a top face and a bottom face, which revetment has open spaces extending between the top faces and the bottom faces, for allowing water to pass through.

Such a revetment is known from NL-C-122279. This known revetment is made of identical elements of a polygonal, convex shape. This shape produces a revetment which has open spaces, which has the advantage that at the underside of the revetment no water pressure which would have a tendency to lift the elements can occur. Such a design is advantageous particularly in the case of revetments of a slope of the type which occurs in the case of sea dikes or river banks. Although the water constantly flowing in waves against the slope can enter by way of said open spaces, at the same time it flows back again unimpeded, in such a way that it cannot grip the elements, and the revetment remains intact.

The disadvantage of this known revetment is, however, that the desired ratio between open and closed surface thereof is found only in the straight parts of a slope. As soon as the slope undergoes a curvature, larger open spaces are bound to remain open, owing to the fact that the known elements then no longer butt up well against each other. The larger open spaces could, of course, be reduced by skilled rearrangement or by filling up with smaller pieces, but skilled personnel is required for this, and such personnel are not always available.

SUMMARY OF THE INVENTION

The object of the invention is to provide a revetment which, on the one hand, is simple to lay using machines and unskilled personnel and which, on the other hand, still allows the correct ratio between open and closed parts to be achieved, even in curved parts of the slope. That object is achieved by the fact that one transverse face of each element is made a concave shape and the other transverse face is made a corresponding convex shape.

Owing to the concave/convex shape of the elements, said elements can be laid so that they butt up well against each other, even in the curved parts of a slope. Moreover, such an advantageous result can be obtained in the case of various gradients, while quay walls can also be revetted with the elements according to the invention. Owing to the open spaces, water cannot make any impression on the revetment.

The elements form rows in which the transverse sides in each row rest against each other and elements from adjacent rows rest with their longitudinal sides against each other.

The revetment known from NL-C-122279 is made with elements whose transverse faces and/or longitudinal faces are formed in such a way that the elements resting against each other leave spaces clear for allowing water to pass through. In the case of the revetment according to the invention, in addition to the concave/convex shape, it is also possible to use the element shapes according to NL-C-122279, which provide open spaces there.

However, in the case of the revetment according to the invention at least one of the transverse faces and/or longitudinal faces preferably comprises a passage opening, which transverse faces and/or longitudinal faces are formed in such a way that the elements resting against each other leave open spaces clear for allowing water to pass through, while the elements can rest with their transverse faces against each other in various rotated positions, and the passage openings each bound an open space with an opposite wall and/or passage opening of an adjacent element.

As an alternative, the elements can contain a passage opening which does not open onto a transverse face or a longitudinal face.

In particular, the transverse faces of the elements can be of a corresponding round shape parallel to the height direction, preferably corresponding approximately to a part of a cylinder. The longitudinal faces of the elements can be essentially flat, in such a way that they can be laid in half-brick bond or also in brick bond. In this case the elements form rows in which the transverse sides in each row rest against each other.

In order to provide the necessary openings, at least one of the longitudinal faces or transverse faces can have a recess.

The invention also relates to an element for use in the revetment according to the invention.

BRIEF DESCRIPTION OF THE DRAWINGS

The invention will be explained in greater detail below with reference to an exemplary embodiment shown in the figures.

BRIEF DESCRIPTION OF THE EMBODIMENTS

Figure 1:
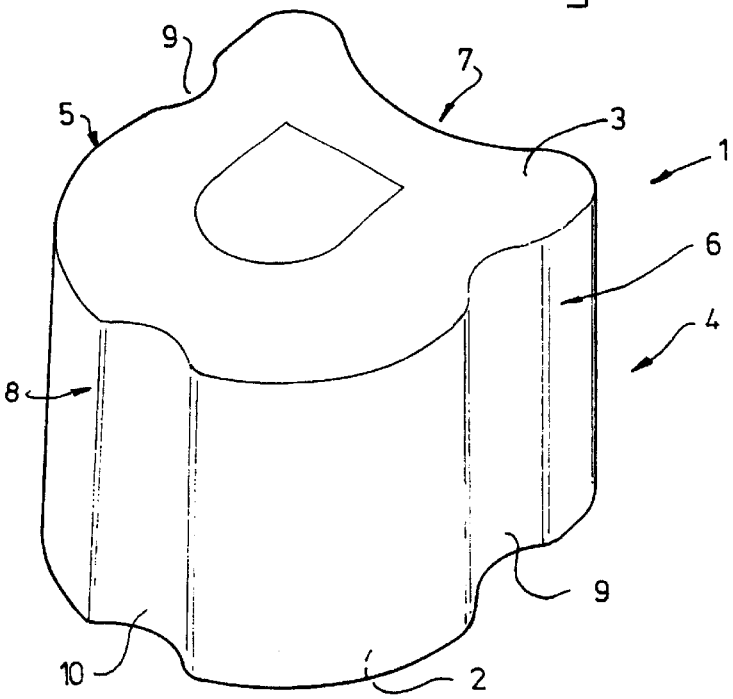
FIG. 1 shows a concrete element according to the invention in perspective.

The element made of concrete shown in FIG. 1 for the revetment of a bank, water-retaining structure and the like, indicated in its entirety by 1, comprises a bottom face 2 (not visible), a top face 3 and a prismatic periphery indicated in its entirety by 4. Said periphery consists of two longitudinal faces 5 (not visible) and 6, and two transverse faces 7 (not visible) and 8.

The periphery 4 has a slight taper and becomes a little narrower towards the top face 3.

The longitudinal faces 5, 6 each have an essentially prismatic recess 9. The rear transverse face 7 of each element is concave, while the front face 8 is convex. Both the concave face 7 and the convex face 8 correspond approximately to a part of a cylinder. The convex face 8 also has an approximately prismatic recess 10.

Figure 2:
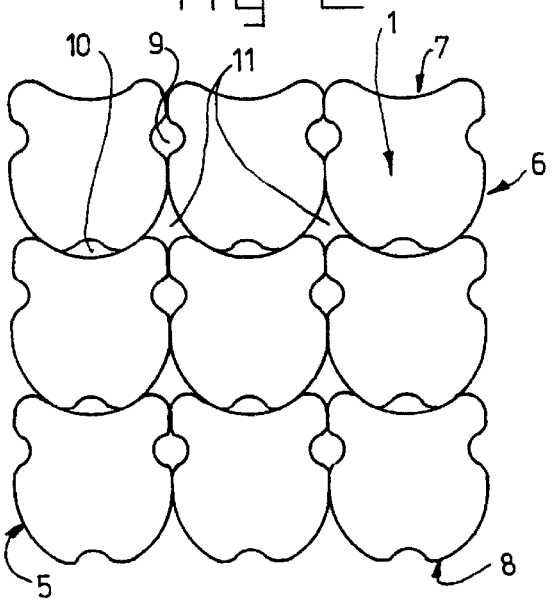
FIG. 2 shows a first laying pattern with the element according to FIG. 1, in a straight course.
Figure 3:
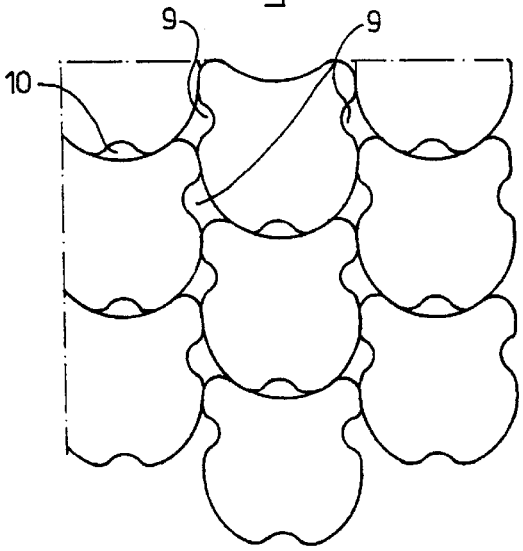
FIG. 3 shows a second laying pattern.

As shown in FIGS. 2 and 3, the concrete elements according to the invention can be used for revetments with different patterns. In FIG. 2 the concrete elements 1 are laid with their longitudinal faces 5 and 6 fully against each other. The recesses 9 in their transverse faces in this case form openings, while the recesses 10 in their front, convex transverse face 8 also form an opening. In addition, openings 11 are present between every four concrete elements 1.

Such recesses can also be found in the case of the half-brick pattern in FIG. 3. Their purpose is to allow water washed by wave action onto the revetment to pass through the revetment just as easily as it is washed back out again. This ensures that excess pressure is not produced underneath the revetment, which would force the elements away or would cause scour to occur underneath the elements.

Figure 4:
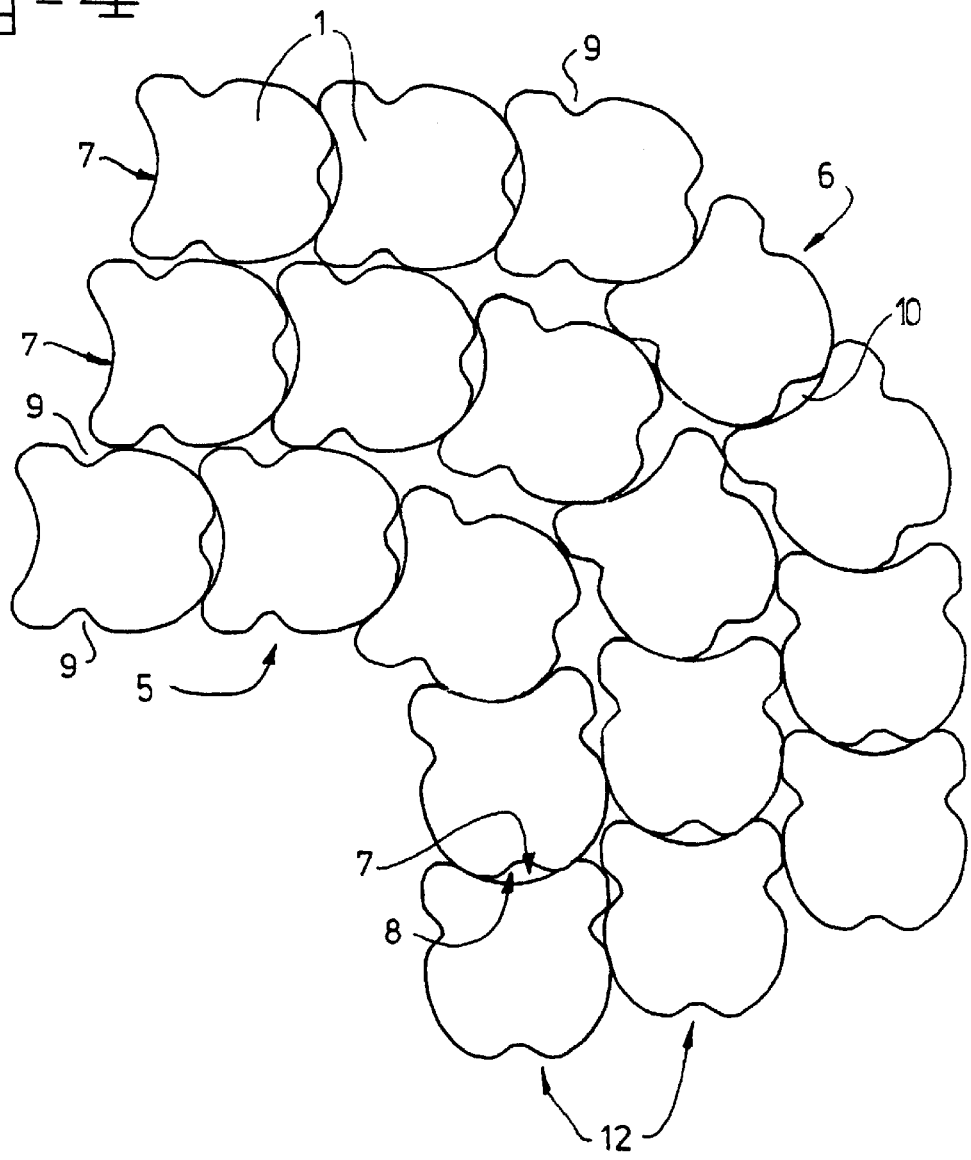
FIG. 4 shows a laying pattern in a curved course.

According to the invention, the concave transverse faces 7 and the convex faces 8 fit into each other at various angular positions, as is clear from the pattern shown in FIG. 4. The elements are laid in various rows 12 one after the other, so that their transverse faces 7, 8 make close contact with each other, irrespective of their mutual angular position.

What is claimed is:

1. Revetment for a water-retaining structure, comprising elements (1) of concrete resting against each other, which elements are approximately prismatic in the height direction and each have two transverse faces (7, 8) and two longitudinal faces (5, 6) between a top face (3) and a bottom face (2), which revetment has open spaces extending between the top faces (3) and bottom faces (2), for allowing water to pass through, wherein one transverse face (7) of each element is made a concave shape and the other transverse face (8) is made a corresponding convex shape, at least one of the transverse faces (7, 8) and/or longitudinal faces having a recess (9, 10), in such a way that the elements rest with their transverse faces against each other in various rotated positions, and the recesses (9, 10) each bound an open space with an opposite wall (5–8) and/or recess (9, 10) of an adjacent element, and wherein the elements (1) form rows (12) in which the transverse sides (7, 8) in each row rest against each other and elements (1) from adjacent rows rest with their longitudinal sides (5, 6) against each other.

2. Revetment according to claim 1, wherein the elements contain a passage opening wich does not open onto a transverse face or a longitudinal face.

3. Revetment according to claim 2, in which the longitudinal faces (5, 6) are essentially flat.

4. An element for a revetment, the element comprising:

a flat top surface, a flat bottom surface that is larger than said top surface, and sloping sides that join said top and bottom surfaces, said sloping sides comprising two opposing longitudinal faces and two opposing transverse faces, a first of said transverse faces having a concave shape with a first radius and a second of said transverse faces having a convex shape with the first radius, said second transverse face having concavity in an apex of the convex shape with a second radius smaller than the first radius, each of said longitudinal faces having a concavity therein of similar size and shape.

5. The element of claim 4, wherein each of the concavities in said longitudinal faces has a concave shape with the second radius.

6. The element of claim 4, further comprising a passage opening through said element that joins said top and bottom surfaces.

* * * * *